United States Patent [19]

Ebey et al.

[11] Patent Number: 4,566,674

[45] Date of Patent: Jan. 28, 1986

[54] NEUTRAL WINCH

[75] Inventors: Edward Ebey, Nashotah; Karl E. Richter, Sheboygan, both of Wis.

[73] Assignee: Fulton Manufacturing Corporation, West Allis, Wis.

[21] Appl. No.: 667,982

[22] Filed: Nov. 5, 1984

[51] Int. Cl.[4] ..... B66D 1/14

[52] U.S. Cl. ..... 254/345; 74/405; 254/376

[58] Field of Search ..... 254/345, 323; 74/405, 74/531, 503; 242/215

[56] References Cited

U.S. PATENT DOCUMENTS

| | | | |
|---|---|---|---|
| 1,379,990 | 5/1921 | Keller | 254/345 |
| 1,942,273 | 1/1934 | Bosworth | 74/503 |
| 2,437,094 | 3/1948 | Hyland | 74/405 X |
| 2,650,835 | 9/1953 | Gonsett | 74/503 X |
| 2,914,907 | 12/1959 | Morrison | 74/405 X |

FOREIGN PATENT DOCUMENTS

| | | | |
|---|---|---|---|
| 425849 | 10/1947 | Italy | 242/215 |

*Primary Examiner*—Stuart S. Levy
*Assistant Examiner*—Katherine Jaekel
*Attorney, Agent, or Firm*—Steven L. Permut; Malcolm L. Sutherland; Leon E. Redman

[57] ABSTRACT

A winch has a drum and drum gear attached thereto. The drum gear is driven by a pinion gear that is attached to an operating shaft which in turn, is attached to an operating handle. The drum side adjacent the drum gear has a plurality of notches which allows the pinion gear to axially slide therethrough to disengage the pinion gear from the drum gear whereby paying out of the rope can be done without spinning of the pinion gear or the operating handle. The pinion gear can remesh with the driving gear by passing through the notch toward its operating position.

9 Claims, 6 Drawing Figures

NEUTRAL WINCH

TECHNICAL FIELD

This invention relates to winches and more particularly, to winches for trailers and the like.

BACKGROUND OF THE INVENTION

Winches are commonly used to hoist a load onto a platform, for example, a boat onto a trailer. If the winch is used to hoist heavy loads, the winch is comonly constructed such that the handle is connected through a pinion gear to a drum gear that is affixed to the drum. The pinion gear provides greater handle revolutions per drum revolutions and increases the torque capacity an operator can handle. Often marine winches have this gear mechanism.

However, no provisions have previously been made to disengage the pinion gear from the drum gear. In other words, the gears are permanently meshed. As a consequence, when an operator pays out line (unwinds the line from the drum by pulling the line), the drum turns and drives the pinion gear which in turn spins the handle. If the line is quickly payed out, the handle spins both rapidly and forcibly. What is needed is a winch that has a neutral position whereby the drum can be disconnected from the handle so that the drum can spin without causing the handle to spin during paying out of the line.

SUMMARY OF THE INVENTION

According to one aspect of the invention, a winch has a frame that rotatably mounts the drum near each drum axle end. The drum has a drum gear rigidly connected thereto. A smaller pinion gear is rigidly mounted to an operating shaft that is parallel to the drum axle. The shaft is rotatably mounted near each of its ends to the frame. A handle is operably connected to the shaft near one end. The shaft is translationally slidable with respect to the frame such that the pinion gear can move between a driving position meshed with the drum gear and a disengaged position, i.e. a neutral position.

Preferably, the shaft and pinion gear assembly is axially slidable along its central axis.

In one embodiment, the drum has one of its sides positioned adjacent the drum gear. The drum side has an outer periphery next to and extending radially beyond the gear teeth of the drum gear. The pinion gear is axially locked in the driving position between the outer periphery of the drum side and a section of the frame. The outer periphery has at least one notch therein to allow the pinion gear to axially pass therethrough for movement between the driving position and neutral position.

Preferably, the operating shaft has an annular groove or detent that can receive a lock. The lock fixes the operating shaft against axial movement in the driving position. The lock includes a spring member having a mounted end attached to the frame, an intermediate end which is received within the annular groove, and a distal tab section that is manually operable such that the spring member can flex to remove the intermediate end from the groove. The shaft is then free to axially move between the driving position and neutral position.

It is desirable that a pawl is pivotally mounted about an axle parallel to the operating shaft. The pawl axle preferably extends through a slot in the tab section of the spring whereby movement of the tab section is guided by the pawl axle. The pawl axle can include an inner bolt member for mounting the pawl and an outer sleeve member. Preferably, the mounting end of the lock spring is tightly interposed between the sleeve and the frame member.

One aspect of the invention is directed to an operating shaft that is positionable between a first and second position with a lock mechanism including an annular groove within the operating shaft and a spring biased lock that can be received within the groove to lock the shaft in one of two axial positions. Flexure of the spring removes the spring from the groove thereby releasing the shaft for axial movement to the neutral position.

In this fashion, an operating handle can be pulled in the axial direction to disengage the pinion gear from the drum gear whereby the winch line can be payed out from the drum with the handle remaining at rest.

BRIEF DESCRIPTION OF THE DRAWINGS

Reference now is made to the accompanying drawings in which.

DETAILED DESCRIPTION OF THE PREFERRED EMBODIMENT

Figure 1:
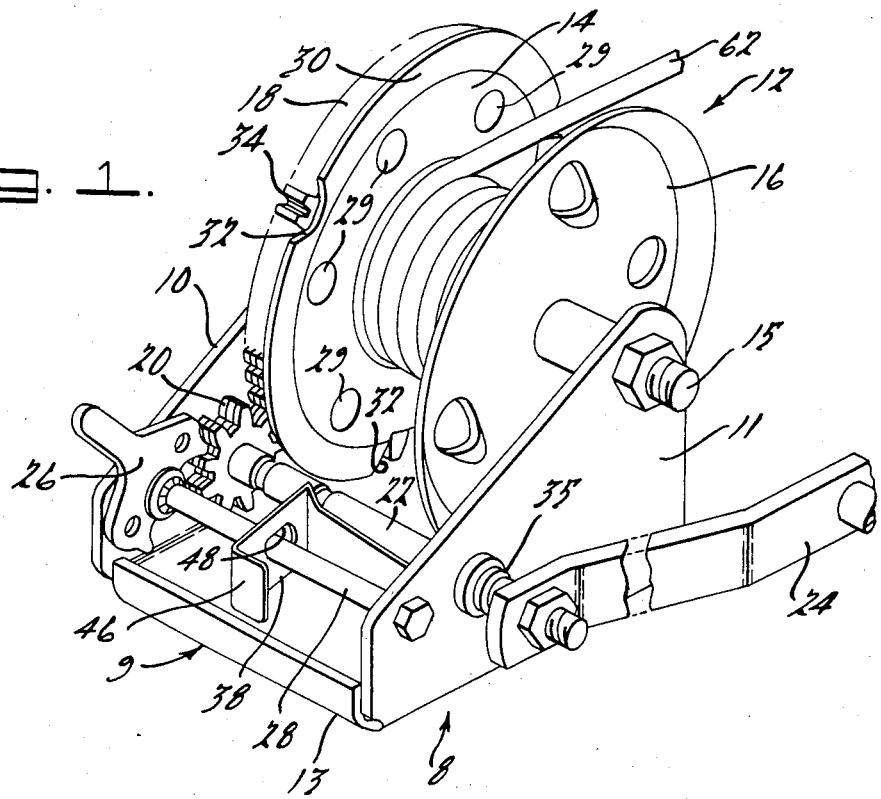
FIG. 1 is a perspective view of a winch according to the invention.

Referring to FIG. 1, a winch 8 includes a frame 9 with a drum 12 rotatably mounted about axle 15 on the frame. The drum 12 includes drum sides 14 and 16 and a drum gear 18. The drum gear 18 is normally meshed with a pinion gear 20 which is rigidly fixed to a rotatable shaft 22 that is connected to an operating handle 24. A pawl 26 is mounted on an axle 28 to engage the pinion gear 20.

Figure 2:
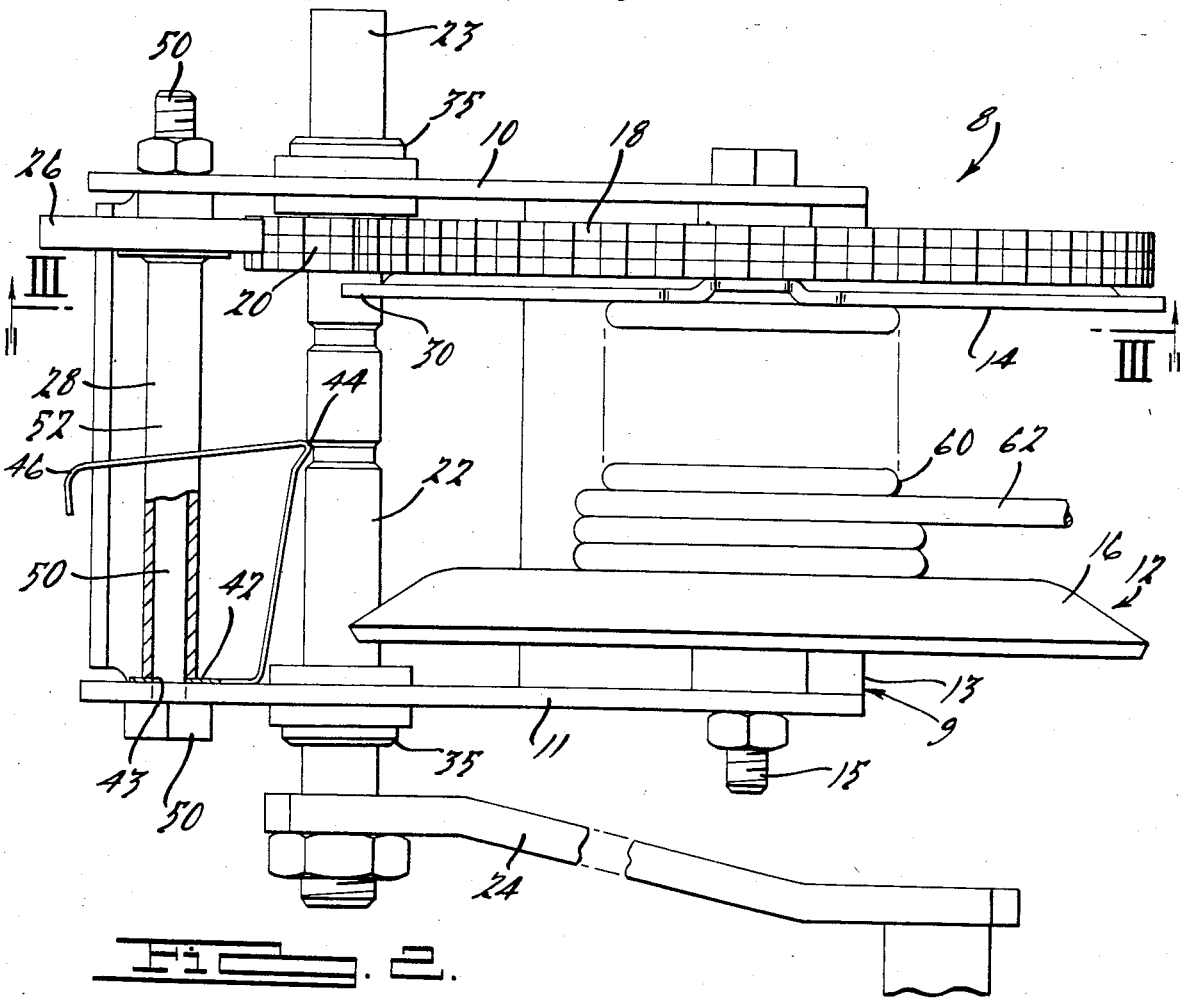
FIG. 2 is a top plan and partially segmented view of the winch shown in FIG. 1.
Figure 3:
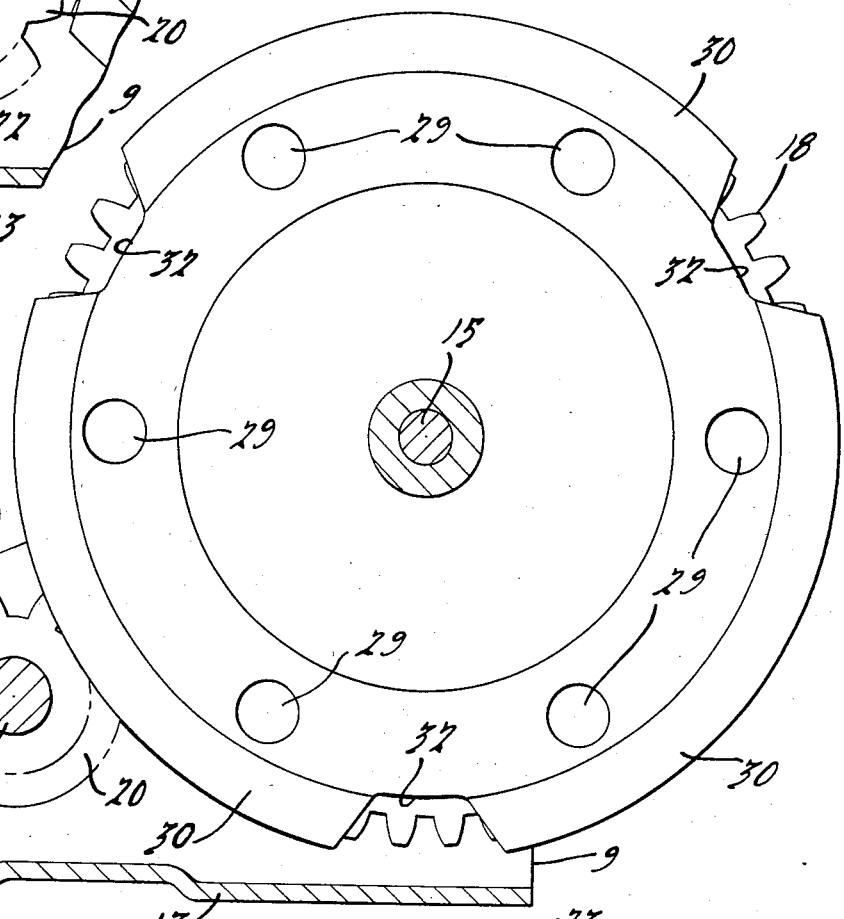
FIG. 3 is a cross-sectional elevational view taken along the lines III—III in FIG. 2.

In more detail, the frame 9 includes two parallel walls 10 and 11 and a base 13. The base 13 is constructed to be mounted on any suitable surface. The drum 12 has its axle 15 mounted through the two walls 10 and 11. Drum side 14 is rigidly secured to the drum gear 18 by rivets 29. The drum side 14 has an outer periphery 30 with three notches 32 formed therein. As shown in FIGS. 2 and 3, the outer periphery 30 radially extends beyond the gear teeth 34 on drum gear 18 and normally traps the pinion gear 20 between the drum side 14 and wall 10 when the notches 32 are misaligned from the pinion gear.

The pinion shaft 22 is axially slidable through the walls 10 and 11 of the frame. Support journal bearings 35 are mounted in walls 10 and 11 to support shaft 22. The shaft 22 has an end section 23 that extends beyond wall 10 a sufficient distance such that when the shaft is axially moved to the position shown in FIG. 6, the shaft end 23 still is journalled by a journal bearing 35. The shaft 22 has two annular grooves 36 and 38.

The pawl 26 is mounted on its axle 28. The pawl 26 can have two ends 54 and 56 either end being able to engage pinion gear 20 depending if the handle is desired to crank clockwise or counterclockwise. Toggle spring 58 is mounted to both pawl 26 and wall 10. The axle 28 includes a central bolt 50 and an outer sleeve 52.

Figure 5:
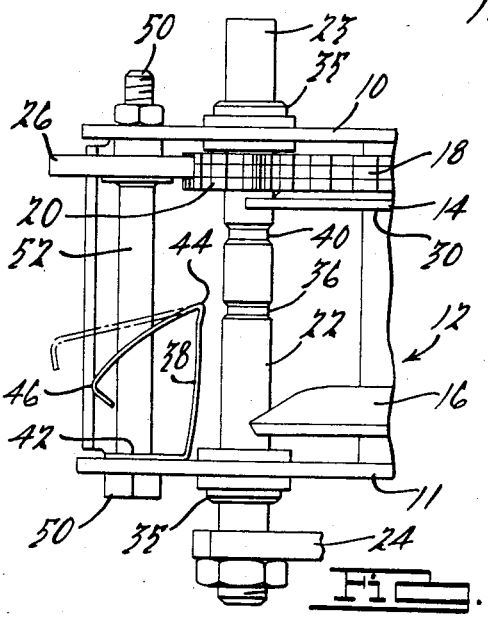
FIG. 5 is a fragmentary plan view showing the pinion gear in the driving position with the lock in the release position.

The lock spring 40 has a mounted end 42 with aperture 43. The lock spring mounted end 42 is tightly interposed between the sleeve 52 and the wall 11 with bolt 50 passing through aperture 43. A folded engaging section 44 engages either of grooves 36 and 38. A distal tab end 46 has a slot 48 therethrough. The sleeve passes through the slot 48 and helps guide the tab end as the spring lock 40 moves between the lock position as shown in FIG. 2 and its release position as shown in FIG. 5.

Figure 4:
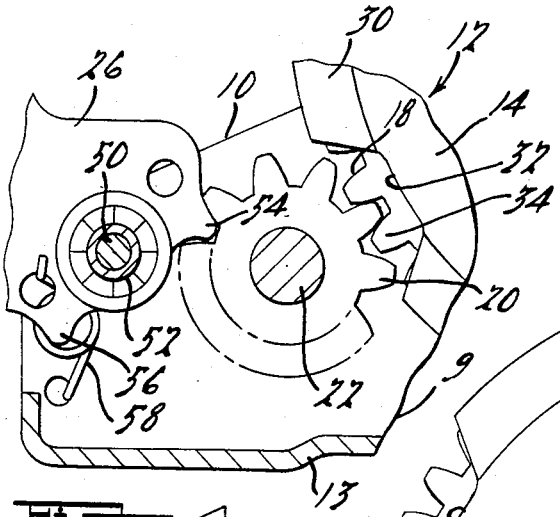
FIG. 4 is a fragmentary cross-sectional side elevational view showing the pinion gear aligned with one of the drum notches.
Figure 6:
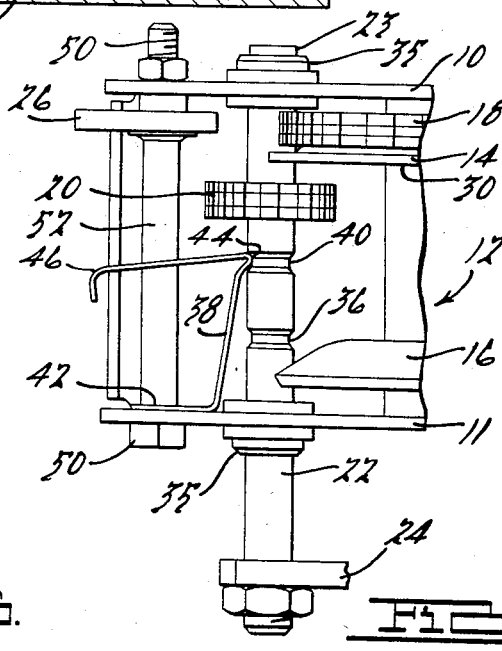
FIG. 6 is the same view as FIG. 4 showing the handle shaft and pinion gear moved to the neutral position.

In operation, when it is desired to pay out the winch line 60 wound about the drum 12 such that its outer end 62 can be attached to a boat or a trailer or another object to be hoisted, the drum is rotated by operation of the handle 24 until one of the notches 32 is aligned with the pinion gear 20 as shown in FIG. 4. At this time, the tab end 46 can be either pulled away from the axle 28 (as shown in phantom in FIG. 5) or slid toward wall 11, as shown in FIG. 5, such that the fold section 44 is released from the annular groove 36. At this time, the handle 24 can be pulled away from the wall 11 to axially move the shaft 22 and pass the pinion gear through the notch 32 and disengage the pinion gear 20 from the drum gear 18 to the neutral position as shown in FIG. 6. The fold section 44 of spring lock 40 can then enter groove 38 to position the shaft 22 and prevent it from jiggling back to the engaged position.

At this time, the line 60 can be grabbed and pulled out the desired distance. The drum 12 is free to rotate accomodating the pay out of the line without driving the pinion gear 20 or causing any spinning of the handle 24.

After the end 62 is attached, the operator can then position the drum 12 such that one of the notches 32 is again aligned with the pinion gear and the handle 24 can be pushed toward wall 11 such that the pinion gear can re-enter the notch 32 and remesh with the drum gear 18. The fold 44 then automatically re-enters groove 36 due to the spring bias of the spring lock 40. The pawl can then be toggled to its proper position to allow the handle to rewind the rope 60.

In this fashion, paying out of rope from a winch can be done effectively and easily without any extra gear or any large handles unnecessarily spinning. The winch is easily operable for moving the pinion gear to disengage from the drum gear and to remeshing the pinion gear with the drum gear.

Variations and modifications of the present invention are possible without departing from the scope and spirit as defined in the appended claims.

The embodiments of the invention in which an exclusive property or privilege is claimed are defined as follows:

1. A winch characterized by:

a frame having two parallel wall sections;

a drum rotatably mounted to said frame with a mounting axle extending between said two wall sections;

a drum gear rigidly secured to said drum;

an operating shaft rotatably mounted on said frame parallel to said drum;

a handle operatively connected to said shaft;

a pinion gear mounted on said shaft for driving engagement to said drum gear when in a driving position;

said shaft being axially slideable on said frame to axially slide said pinion gear from said driving position to a disengage position to disengage from said drum gear and place said winch in a neutral mode;

an annular detent on said shaft;

a lock means attached to the frame and being receivable in said detent for locking said shaft in one axial position that positions said pinion gear in engagement with said drum gear;

said lock means including a spring member having one mounting end attached to one of said wall sections;

said spring member having an intermediate folded section which is receivable in said annular detent;

said spring member having a distal tab section that is manually engageable to be moved such that said spring member can flex and exit said detent to allow said shaft member to axially move; and said spring member being biased to enter said detent when said shaft is in the engaged position.

2. A winch as defined in claim 1 further characterized by:

a pawl pivotably mounted about an axle paralled to said shaft;

said pawl axle extends through a slot in said tab section of said spring whereby movement of said tab section is guided by said pawl axle.

3. A winch as defined in claim 2 wherein:

said pawl axle includes an inner bolt and outer sleeve, said inner bolt passes through said mounting end of said spring, said outer sleeve abuts said mounting end such that said mounting end is tightly interposed between said sleeve and a wall section of said frame.

4. A winch characterized by:

a frame having two parallel wall sections;

a drum rotatably mounted to said frame with a mounting axle extending between said two wall sections;

a drum gear rigidly secured to said drum;

an operating shaft rotatably mounted on said frame parallel to said drum;

a handle operatively connected to said shaft;

a pinion gear mounted on said shaft for driving engagement to said drum gear when in a driving position;

said shaft being axially slideable on said frame to axially slide said pinion gear from said driving position to a disengage position to disengage from said drum gear and place said winch in a neutral mode;

said drum having a side adjacent said drum gear;

said side having an outer periphery extending radially beyond gear teeth of said drum gear to axially lock said pinion gear in said driving position between said drum side and one of said wall sections of said frame; and said outer periphery having at least one notch therein to allow said pinion gear to axially pass therethrough for movement between said disengaged position and said driving position.

5. A winch characterized by:

a frame member;

a drum member rotatably mounted to said frame member for taking up line of said winch;

a handle member rotatably mounted on said frame and operatively connected to said drum for cranking said drum so that said line can be wound upon said drum;

shift means for selectively disengaging said handle from said drum such that said handle remains stationary on said frame when said drum spins as said line is payed out;

said drum mounted to a drum gear;

a pinion operably meshed with said drum gear;

said handle operatively connected to said pinion gear for cranking said drum;

said shift means selectively disengaging said pinion gear from said drum;

a shaft connecting said handle to said pinion gear;

said shaft being axially slideable on said frame to axially slide said pinion gear to disengage from said drum gear and place said winch in a neutral mode;

said drum having a side adjacent said drum gear;

said side having an outer periphery extending radially beyond gear teeth of said drum gear to axially lock said pinion gear in said meshed position with said drum gear between said drum side and said frame; and said outer periphery having at least one notch therein to allow said pinion gear to axially pass therethrough for movement between said meshed position and said neutral mode.

6. A spring lock for a winch characterized by:

a spring member having an end section mounted on a frame of said winch;

said spring member including a locking cam section engageable to an annular groove on a rotatable shaft that is operably connected to a pinion gear; and said spring member including a tab section that is manually engageable to flex said spring member and release said cam section from said annular groove to allow said shaft to axially move and in turn to axially move said pinion gear to disengage from a drum gear of said winch.

7. A spring lock as defined in claim 6 further characterized by:

said tab section having a hole therethrough that receives a pawl axle of said winch.

8. A spring lock as defined in claim 6 further characterized by:

said end section being tightly interposed between said frame member of said winch and a sleeve member forming in part a pawl axle of said winch.

9. A spring lock as defined in claim 8 wherein:

said end section has an aperture therethrough which receives a bolt that forms in part the pawl axle.

* * * * *